United States Patent [19]

Wallick, Jr.

[11] Patent Number: 4,766,976

[45] Date of Patent: Aug. 30, 1988

[54] LADDER LEG EXTENDER AND LEVELER

[75] Inventor: Claude R. Wallick, Jr., Jefferson County, Ky.

[73] Assignee: Emerson Electric Co., St. Louis, Mo.

[21] Appl. No.: 90,754

[22] Filed: Aug. 28, 1987

[51] Int. Cl.[4] ..... E06C 7/44

[52] U.S. Cl. ..... 182/201; 248/188.2; 248/188.8; 182/111

[58] Field of Search ..... 182/201, 202, 204, 205, 182/111; 248/188.2, 188.8, 188.9

[56] References Cited

U.S. PATENT DOCUMENTS

| | | | |
|---|---|---|---|
| D. 230,370 | 2/1974 | Kaye | 182/204 |
| 970,425 | 9/1910 | Curran | 182/205 |
| 1,179,391 | 4/1916 | Bachman | 182/204 |
| 2,911,134 | 11/1959 | Derby | 182/201 |
| 2,914,135 | 11/1959 | Crouch | 182/201 |
| 3,000,041 | 9/1961 | Reynolds | 248/188.8 |
| 3,021,921 | 2/1962 | Poelvoorde | 182/201 |
| 3,083,788 | 4/1963 | Studer | 182/205 |
| 4,073,367 | 2/1978 | Wright | 182/204 |
| 4,209,078 | 6/1980 | Gerber | 182/204 |

*Primary Examiner*—Reinaldo P. Machado
*Attorney, Agent, or Firm*—Polster, Polster and Lucchesi

[57] ABSTRACT

An improved ladder leg extender and leveler assembly including a frame structure which can be fixed in flush face-to-face relation to a ladder leg side so as to straddle rung fastener protrusions on the ladder leg side, thus avoiding bending stresses, the arrangement permitting quick and efficient assembly.

7 Claims, 1 Drawing Sheet

LADDER LEG EXTENDER AND LEVELER

BACKGROUND OF THE INVENTION

The present invention relates to an improved ladder structure and more particularly to an improved ladder leg extender and leveler structural arrangement which can be mounted to the side face of a ladder leg.

Ladder attachments for ladders to extend and level the legs thereof are generally known in the art, attention being directed for example to the soon to expire design patent, U.S. Pat. No. Des. 230,370, issued to L. A. Kaye on Feb. 12, 1974 and to the expired U.S. Pat. No. 3,099,103, issued to A. J. Wright on July 30, 1963. The Wright patent teaches a ball joint foot formed of a resilient material and a non-slip bottom surface to permit connection to a ladder leg extender through a ball and socket joint with the ball being force fit into a resilient socket. Such an arrangement has been comparatively complex in manufacture and assembly and subject to possible hazardous separation under stress conditions. Moreover, this and other past ladder extender and lever attachment arrangements often have been concerned with appearance and footing and have failed to consider, let alone recognize, the mounting and durability limitations of the attachments with respect to various types of ladders, particularly those which require positioning of a lower rung or step of a ladder proximate to the ladder leg base to enhance ladder strength.

The present invention recognizing the problems of past ladder attachments for extending and leveling ladders provides a novel and unique ladder leg extender and leveler arrangement which is straightforward and economical in manufacture and assembly, which assures ready mounting to ladder legs with minimal bending stresses during ladder usage and which minimizes the hazardous risks of inadvertent lock release.

Various other features of the several parts of the present invention will become obvious to one skilled in the art upon reading the disclosure set forth herein.

SUMMARY OF THE INVENTION

More particularly, the present invention provides a ladder leg extender and leveler comprising:

a longitudinally extending frame means adapted to be fixed in flush face-to-face relation to the side of a ladder leg by straddling rung fastener protrusions thereon;

a longitudinal extension leg slidably mounted relative the frame means, the extension leg having a first connection fitting fixed to the lower end thereof;

clamp means cooperatively mounted relative the extension leg to releasably lock the extension leg in a preselect fixed adjusted position relative the frame and the ladder leg to which it is mounted;

a shoe plate having a second connection fitting fixed to the upper face thereof for pivotal coupling to the first connection fitting on the extension leg; and, a shoe pad fastened to the lower end of the shoe plate.

In addition, the present invention provides a novel cover plate guide arrangement to minimize inadvertent release of the clamping means, a novel ball and socket arrangement and a novel fastening means for the overall shoe assembly.

It is to be understood that various changes can be made by one skilled in the art in one or more of the several parts of the apparatus disclosed herein without departing from the scope or spirit of the present invention.

BRIEF DESCRIPTION OF THE DRAWING

Referring to the drawing, which discloses one advantageous embodiment of the inventive ladder leg extender and leveler.

DETAILED DESCRIPTION OF THE DRAWING

Figure 2:
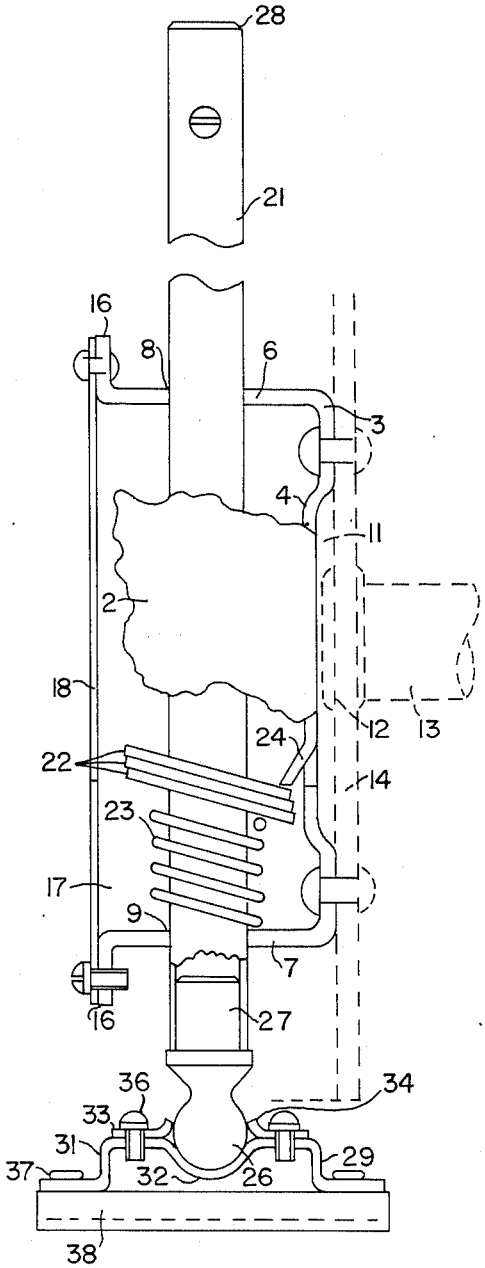
FIG. 2 is a partially broken away side view of the apparatus of FIG. 1, disclosing in phantom the manner in which the frame can be mounted to a ladder leg with the recessed portion accommodating or in effect straddling a rung fastener protrusion to permit face-to-face mounting.

Referring particularly to FIG. 2 of the drawing, it can be seen that the novel extender and leveler 2 includes a frame member 3 which is U-shaped in cross-section to provide a base leg member 4 with opposite extremities turned to provide a pair of spaced horizontal leg members 6 and 7. Leg members 6 and 7 are provided with spaced aligned apertures 8 and 9, respectively. Advantageously, frame member 3 can be formed from a unitary strip of metal bent or alternatively cast to shape with base leg member 4 recessed at 11. In accordance with one feature of the present invention, the recess 11 permits straddling of fastener protrusion 12 for ladder rung or step 13 which extends cross-wise of the ladder legs 14, only a portion of this ladder structure being shown in phantom for illustration purposes. It is to be understood that the present invention recognizes that a number of types of ladders require rungs at the lowermost portion thereof for structural strength. The present invention further recognizes that, accordingly, the frame of a ladder extender has necessarily in the past been mounted to overlap a rung fastener protrusion and thus undesirable bending stresses have been placed on the fasteners which are used to mount a frame to a ladder leg side. To avoid these undesirable bending stresses, the present invention has provided base leg recess 11 to permit the face-to-face abutment of the frame base leg to the ladder at points of fastening.

In accordance with still another feature of the present invention, the horizontal leg members 6 and 7 of frame member 3 are turned outwardly at their extremities to provide spaced plate mounting tabs 16. These tabs serve to support a cover plate 17 fastened thereto at its extremities. Plate 17 is provided with a suitable limited access opening 18 positioned in the plate to permit limited access to the clamping arrangement described hereinafter, thus minimizing the hazardous risk of inadvertent clamp release. It is to be noted that cover plate 18 can include suitable side wing covers 19 to prevent side access to the clamping means.

Figure 1:
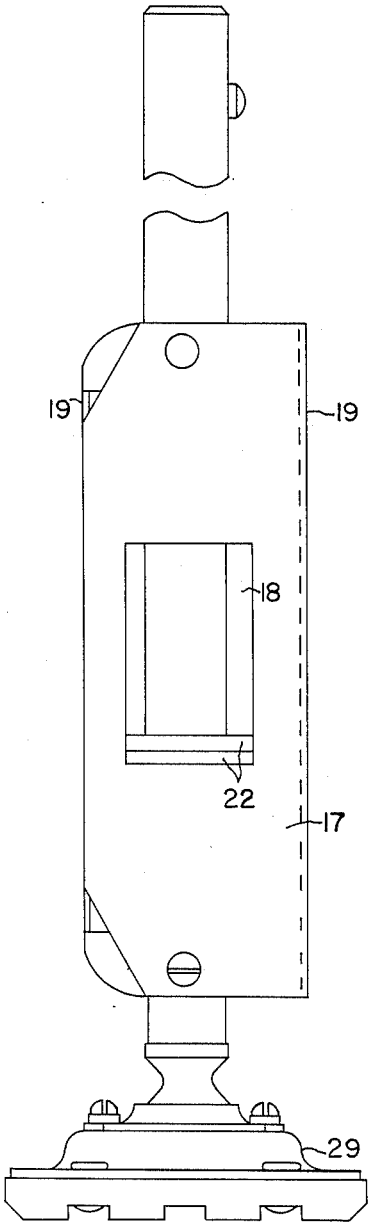
FIG. 1 is a front end view of the novel arrangement.

As can be seen in the drawing, FIGS. 1 and 2, a hollow longitudinal extension leg 21 is arranged to slidably pass through aligned apertures 8 and 9 of frame member 3. A number of stacked annular clamp plates 22 (three as shown) are slidably mounted thereon above helical spring 23 also disposed thereon with the lower extremity of spring 23 resting on lower horizontal leg member 7. The upper end of spring 23 urges against stacked plates 22, forcing the uppermost plate to resiliently press against clamp stop protrusion 24 and thus lock leg 21 in a preselected extended position with plates 22 frictionally pressing against the outer wall of extension leg 21. To release leg 21 from clamped position, it is only necessary for an operator to purposefully reach through opening 18 of plate cover 17 and press the plates downwardly against spring 23—the cover plate 17 and the side wing covers 19 minimizing inadvertent clamp release.

In accordance with still another feature of the present invention, hollow extension leg 21 is provided at its lower extremity with a connection fitting in the form of a swivel ball 26 having a stem 27 which is press fit into the lower extremity. A suitable plug cap 28, which can be of a suitable plastic, serves to cover the upper extremity of extension leg 21.

Arranged to be attached to swivel ball 26 is a shoe assembly 29 (FIG. 1). As can be seen in FIG. 2, shoe assembly 29 includes a shoe plate 31 which can be of a suitable metallic material, is contoured and sized to include a cup socket portion 32 which nestingly receives the lower section of swivel ball 26 to permit swivel motion therebetween. A bearing plate 33, which also can be formed from a suitable metallic material, is fastened to the upper face of shoe plate 31, the bearing plate 33 being contoured and sized to include a flange portion 34, which nestingly engages the upper section of the swivel ball to restrain the ball 26 in cup socket 32. As can be seen in FIG. 2, suitable screw fasteners 36 can be employed to fasten bearing plate 33 to shoe plate 31.

Fastened to the lower or under face of shoe plate 31 by means of suitable fasteners 37 is shoe pad 38. Pad 38 can be made from a suitable hard, non-skid, elastomeric material, it being noted that, in accordance with still another feature of the present invention, it would be possible to further facilitate manufacturing and assembly costs by assembling shoe plate 31, bearing plate 33 and shoe pad 38 with the same set of fasteners.

Thus, from the above, it can be seen that a unique and novel leg extender and leveler arrangement is provided which not only is economical and straightforward in manufacture and assembly but which in addition is durable and which minimizes hazardous risks.

The invention claimed is:

1. A ladder leg extender and leveler comprising:

a longitudinally extending frame means having a side thereof adapted to be fixed with spaced portions of said frame side in flush face-to-face relation to the side of a ladder leg independent of the ladder rungs and with an intermediate portion of said frame side straddling rung fastener protrusions extending from the outer face of said leg so as to be uninterrupted thereby and yet minimize bending stresses;

a longitudinal extension leg slidably mounted relative said frame means; said extension leg having a first connection fitting fixed to the lower end thereof;

clamp means cooperatively mounted relative said extension leg to releasably lock said extension leg in a preselected fixed adjusted position relative said frame means and the ladder leg to which it is mounted;

a shoe plate having a second connection fitting fixed to the upper face thereof for pivotal coupling to said first connection fitting on said extension leg; and a shoe pad fastened to the lower face of said shoe plate.

2. The ladder leg extender of claim 1, said frame means including a flat cover plate guard spaced from the actuating extremity of said clamp means and having a limited access opening therein adjacent to said clamp means to permit access to said actuating extremity for releasable locking with minimum inadvertent contact of said clamp means for safety.

3. The apparatus of claim 1, said first connection fitting on said extension leg including a swivel ball fixed to the lower end thereof in alignment with the longitudinal axis of said leg and said second connection fitting on said shoe plate including a cup socket formation to nestingly receive said swivel ball; and, a bearing plate fastened to the upper face of said shoe plate, said bearing plate being contoured and sized to include a flange portion to nestingly engage the upper section of said swivel ball to restrain said swivel ball in said shoe cup of said shoe plate.

4. The ladder leg extender of claim 3, said shoe and bearing plates being of long-wearing metallic material and said shoe pad being of hard elastomeric material.

5. The ladder leg extender of claim 3, said shoe and bearing plates and said shoe pad being fastened together by a common set of fasteners.

6. The ladder leg extender of claim 3, said extension leg being hollow at the lower portion thereof, said swivel ball having a stem member extending therefrom press-fit into nesting relation in the hollow lower portion of said extension leg.

7. A ladder leg extender and leveler comprising:

a U-shaped metallic unitary frame section including a vertical longitudinally extending base leg member adapted to be fixed flush face-to-face relation with the side of a ladder leg with opposite extremities thereof turned to provide a pair of spaced horizontal leg members having spaced aligned apertures therethrough with the extremities of said leg members turned to provide cover plate mounting tabs and with the vertically extending base member having an offset recessed portion to be spaced from and accommodate ladder leg rung fastener protrusions extending from the outer face of said leg so as to be in spaced relation therefrom and uninterrupted thereby permitting said flush face-to-face mounting to said ladder leg side to minimize bending stresses, said recessed portion being lanced to provide a clamp stop protrusion;

a hollow longitudinal extension leg slidably passing through said spaced aligned apertures in said horizontal leg members of said unitary frame, said extension leg having at least one clamp plate slidably mounted thereon to resiliently and releasably engage said clamp stop protrusion;

a flat cover plate guard extending between and fastened to said cover plate mounting flanges of said horizontal leg members to be spaced from the actuating extremity of said clamp plate, said cover plate guard having a limited access opening adjacent to said clamp plate to permit access to said actuating extremity for releasable locking of said extension leg with minimum inadvertent contact therewith;

a swivel ball having a stem member extending therefrom pressfit into nesting relation in the hollow lower extremity of said extension leg in alignment with the longitudinal axis of said extension leg;

a metallic shoe plate having the upper face contoured and sized to include a cup socket portion to nestingly receive the lower section of said swivel ball;

a hard elastomeric shoe pad fastened to the lower face of said shoe plate;

a metallic bearing plate fastened to the upper face of said shoe plate, said bearing plate being contoured and sized to include a flange portion to nestingly engage the upper section of said swivel ball to restrain said swivel ball in said cup portion of said shoe plate; and, fastening means to hold said plates and pad in assembled relation.

* * * * *